US007311134B2

(12) United States Patent
Cheng

(10) Patent No.: US 7,311,134 B2
(45) Date of Patent: Dec. 25, 2007

(54) PULLING CORD WINDING APPARATUS FOR WINDOW SHADES

(76) Inventor: Li-Ming Cheng, No. 215, Jiouru 1st Rd., Sanmin District, Kaohsiung City (TW)

( * ) Notice: Subject to any disclaimer, the term of this patent is extended or adjusted under 35 U.S.C. 154(b) by 343 days.

(21) Appl. No.: 11/048,913

(22) Filed: Feb. 3, 2005

(65) Prior Publication Data

US 2006/0169422 A1 Aug. 3, 2006

(51) Int. Cl.
*E06B 9/322* (2006.01)

(52) U.S. Cl. ..... 160/173 R; 242/381.3; 160/170

(58) Field of Classification Search ..... 160/170, 160/171, 178.1 R, 168.1 R, 173 R, 178.2; 242/372, 378.4, 381, 381.3, 381.6, 385.3, 242/385.4

See application file for complete search history.

(56) References Cited

U.S. PATENT DOCUMENTS 794,937 A * 7/1905 Hopkins ..... 160/279
6,024,154 A * 2/2000 Wang et al. ..... 160/170
6,675,861 B2 1/2004 Palmer et al.
6,823,925 B2 * 11/2004 Militello et al. ..... 160/170
2005/0205219 A1 * 9/2005 Hsu ..... 160/170
2006/0175022 A1 * 8/2006 Cheng ..... 160/170
2006/0175023 A1 * 8/2006 Cheng ..... 160/170

* cited by examiner

*Primary Examiner*—Blair M. Johnson
(74) *Attorney, Agent, or Firm*—Birch, Stewart, Kolasch & Birch, LLP

(57) ABSTRACT

A pulling cord winding apparatus for window shades includes an upper cap, a lower seat, two elastic take-up reels, two elastic coils, a brake member, and a push rod. The brake member has two arched pressing plates on two sides extended outwards to form respectively a cord pressing member which has second teeth on one side to engage with first teeth formed on cord clamping members on two outer sides of the housing compartment. When pushing the push rod, the brake member is moved and escapes to enable the two elastic take-up reels to rotate and brake. Through the arched pressing plates, cord pressing members and cord clamping members, pulling cords may be retracted smoothly without entangling or forming knobs. When the two elastic take-up reels retract the cords at the maximum force, the pulling cords do not slip, and the window shade may be extended and retracted as desired.

9 Claims, 7 Drawing Sheets

PULLING CORD WINDING APPARATUS FOR WINDOW SHADES

FIELD OF THE INVENTION

The present invention relates to a pulling cord winding apparatus for window shades that includes a push rod and a brake member that are movable and an arched pressing plate to prevent pulling cords from entangling or forming knobs during winding, and also has cord pressing members and cord clamping members to prevent two elastic coils from slipping at the maximum force during cords winding to extend and retract a window shade.

BACKGROUND OF THE INVENTION

A conventional window shade generally is lifted or lowered through a rope. The rope usually is exposed outside and could cause a hazardous condition by tangling or strangling children playing nearby. Hence for safety reason the rope of the window shade is generally collected in a winding device located on the bottom rail of the window shade without exposing to prevent risks.

There are many types of pulling cord winding devices for window shades on the market. FIG. 1 illustrates one of the examples (namely U.S. Pat. No. 6,675,861 B2). It has a pulling cord winding device A installed on a front end of a bottom rail B1. The device includes a cord braking board A1 which has an upper pressing member A10 and a lower pressing member A11 which is coupled with a collar A12 to clamp a pulling cord C. When a window shade B is extended or retracted, the upper pressing member A10 is pushed downwards by a spring A13 to compress the pulling cord C. The compression surface A101 of the upper pressing member A10 and an opening A120 of the collar A12 form a V-shape shearing force (referring to FIG. 2A). The pulling cord C tends to be severed by the shearing force. When the lower pressing member A11 is moved upwards, the compression surface A111 of the lower pressing member A11 and a bore A100 of the cord braking board A1 form an inverted V-shape shearing force. This also tends to sever the pulling cord C (referring to FIG. 2B). Hence the pulling cord C is difficult to be anchored on a desired location. The aforesaid pulling cord winding device A not only is troublesome during operation, but also cannot anchor the window shade on a desired location during extension and retraction. Moreover, the pulling cord winding device A consists of many elements, and is too bulky. A bigger bottom rail B1 is needed to hold the pulling cord winding device A. In short, the entire device takes too much space and is too costly. The enlarged bottom rail B1 also becomes too heavy. And the spring A13 installed inside the pulling cord winding device A has to withstand a greater force. This shortens the service life of the device.

SUMMARY OF THE INVENTION

In view of the aforesaid disadvantages occurred to the conventional winding devices that cannot be anchored on a desired location during extension and retraction, and are bulky and costly, the primary object of the present invention is to provide a pulling cord winding apparatus for window shades that is lighter and has a smaller thickness to reduce the force exerted on the spring in the pulling cord winding apparatus. The invention is compact and may be easily installed on the bottom rail of the window shade.

The pulling cord winding apparatus for window shades of the invention includes an upper cap and a lower seat that are coupled together, two elastic take-up reels mounted on holding struts located in a center housing compartment formed on the lower seat, an elastic coil housed in each elastic take-up reel that has two ends latched thereon, a brake member coupled on a post located on one side of the housing compartment of the lower seat, and a push rod pressing the brake member. The push rod may be pushed to move the brake member to enable the elastic coils to be retracted or released thereby to extend or retract the window shade.

Another object of the invention is to form a latch slot on the anchor strut and a retaining member on an inner perimeter of the elastic take-up reel that has a latch trough to allow the two ends of the elastic coil to wedge in the elastic take-up reel.

Yet another object of the invention is to provide arched pressing plates on two sides of the brake member that have cord pressing members extended outwards. The cord pressing members have second teeth to engage with first teeth of cord clamping members located on two outer sides of the housing compartment. Hence when the push rod is pushed to move the brake member, the brake member escapes to enable the two elastic take-up reels to rotate and brake, the two elastic coils are retracted or released to enable the window shade to be extended, retracted and anchored on a desired location.

Still another object of the invention is to manage the pulling cords through the arched pressing plates, cord pressing members, and cord clamping members so that the pulling cords are retracted in a tidy manner without entangling or forming knobs, and the two elastic coils can retract the pulling cords without slipping at the maximum force.

Further scope of the applicability of the present invention will become apparent from the detailed description given hereinafter. However, it should be understood tat the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of die present invention, and wherein.

DETAILED DESCRIPTION OF THE PREFERRED EMBODIMENTS

Figure 1:
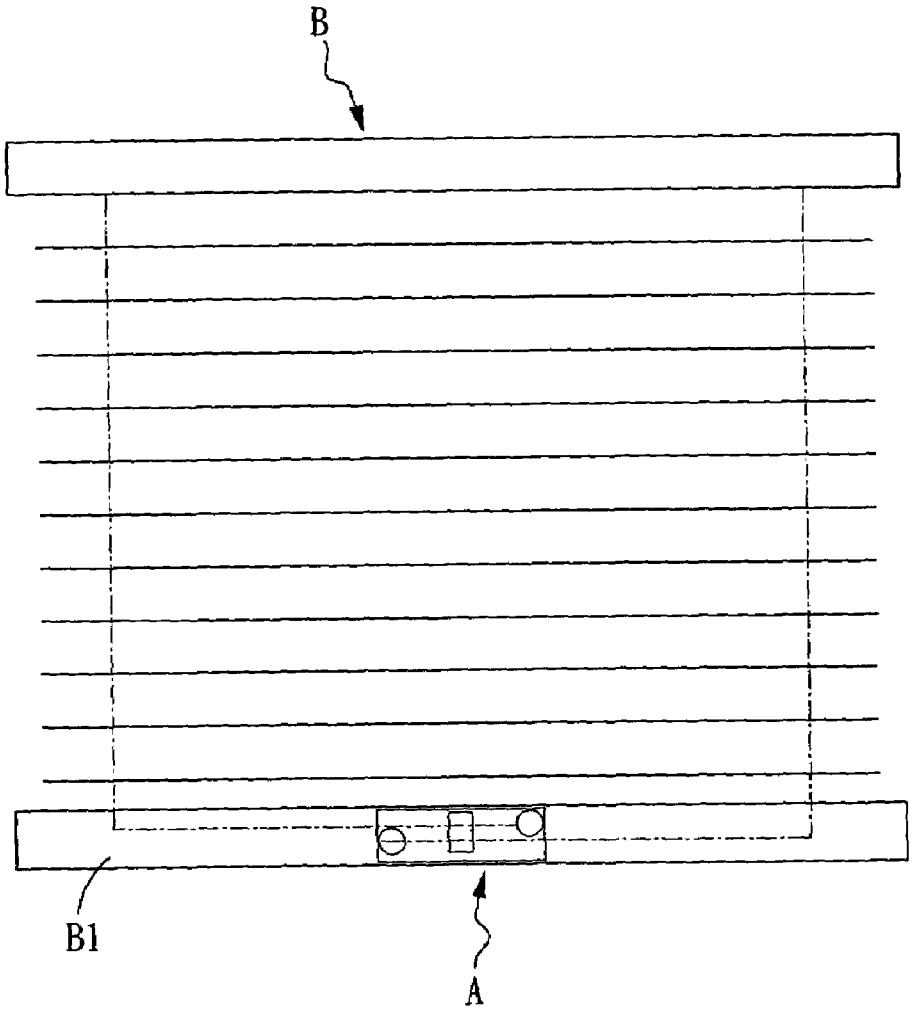
Fig. 1 PRIOR ART
FIG. 1 is a front view of U.S. Pat. No. 6,675,861 B2.
Figure 2A:
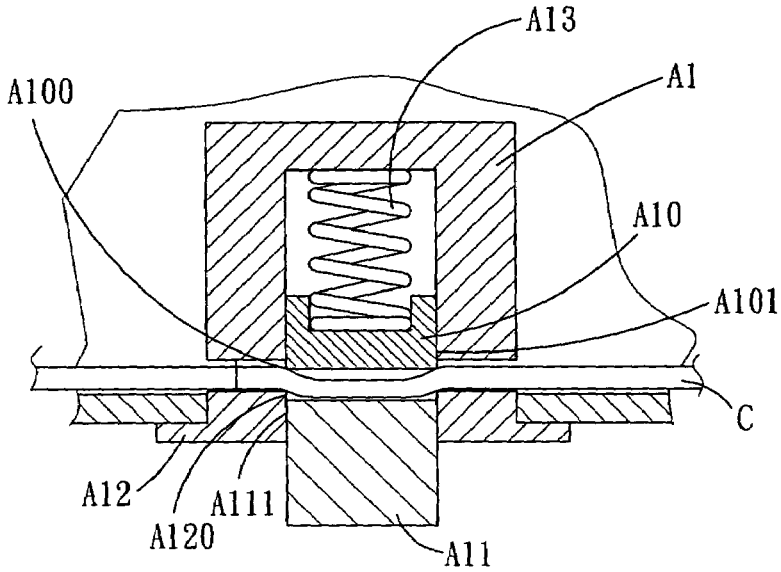
Fig. 2A PRIOR ART
FIG. 2A is a schematic view according to FIG. 1 showing the upper pressing member and the lower pressing member compressing a pulling cord.
Figure 2B:
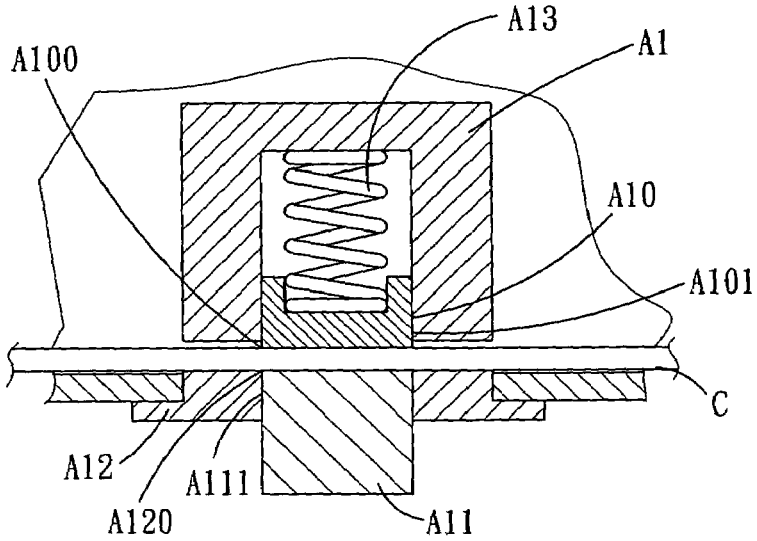
Fig. 2B PRIOR ART
FIG. 2B is another schematic view according to FIG. 1 showing the upper pressing member and the lower pressing member compressing a pulling cord.
Figure 3:
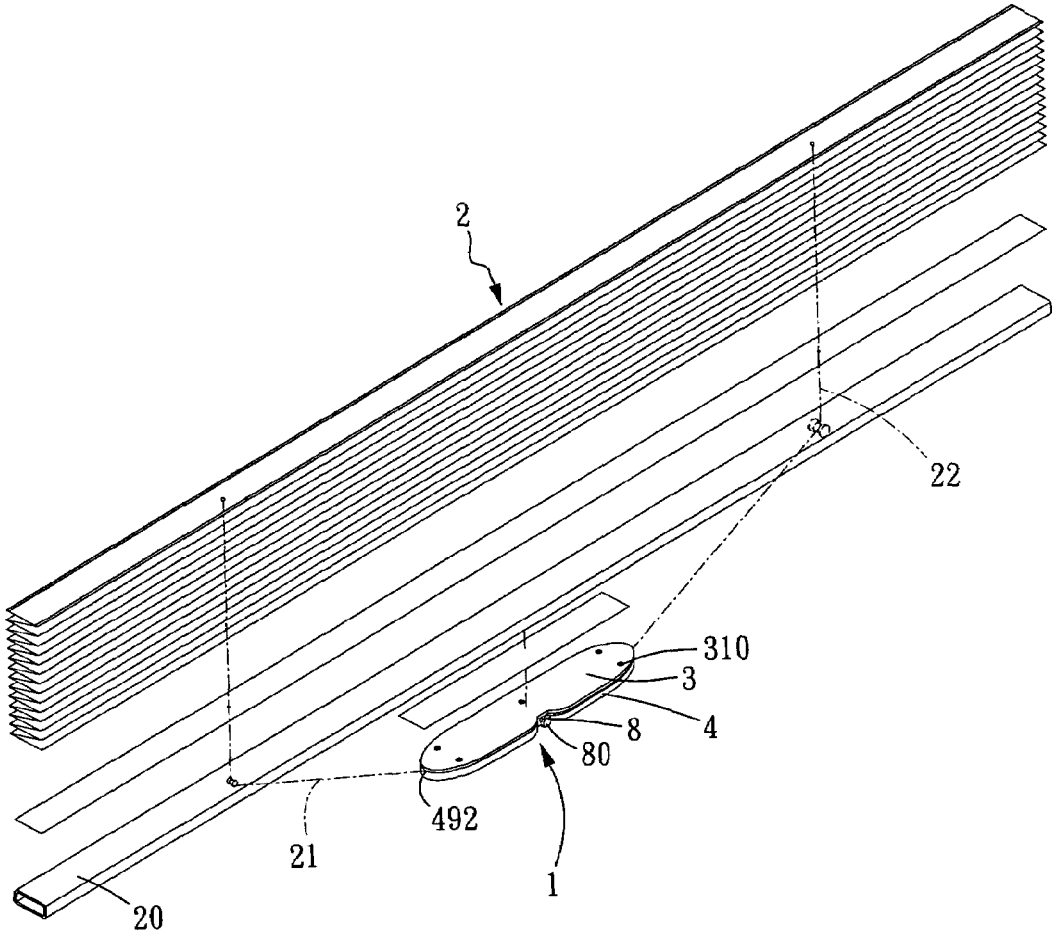
FIG. 3 is an exploded view of the present invention.
Figure 4:
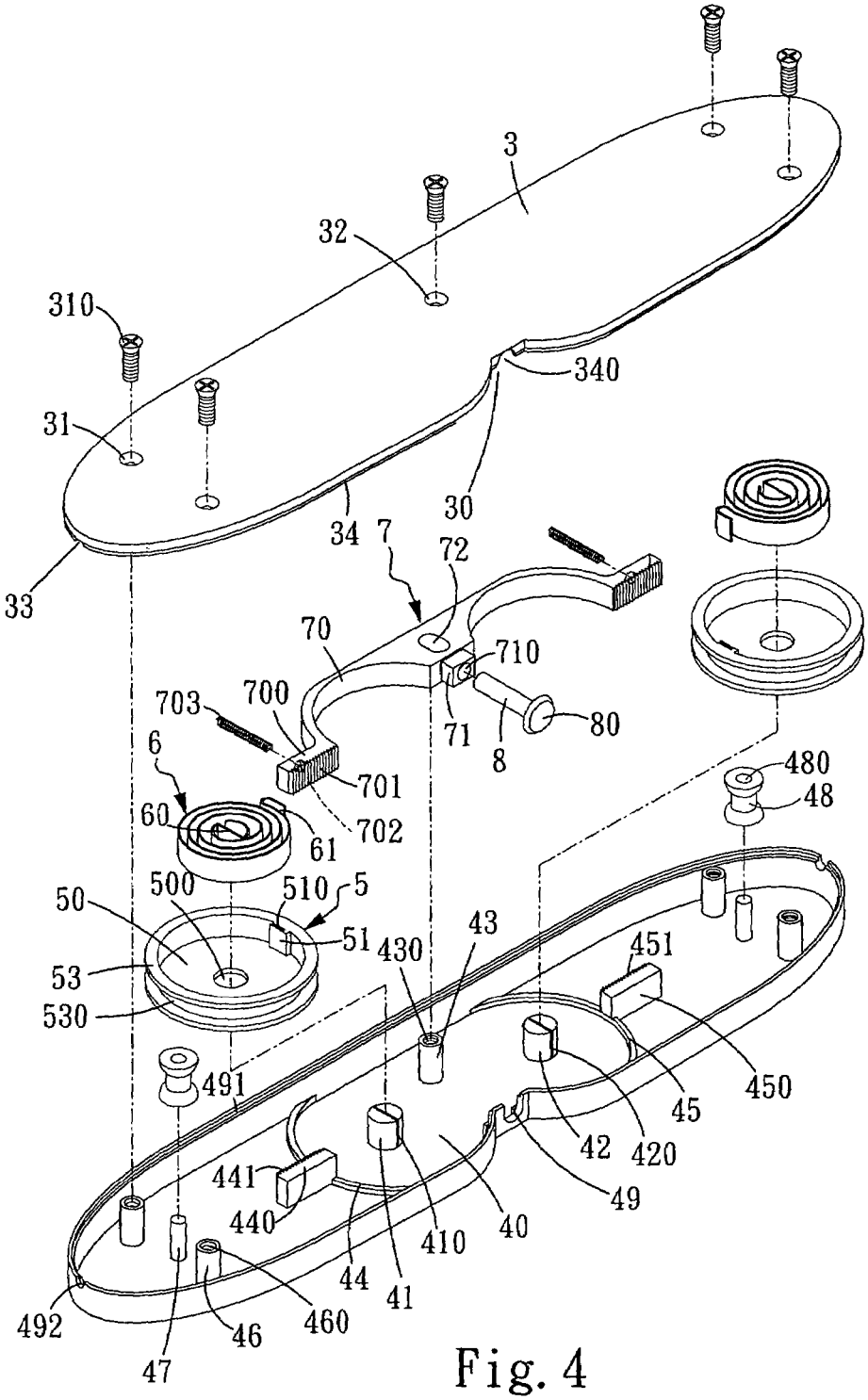
FIG. 4 is an exploded view of the pulling cord winding apparatus of the present invention.

Please refer to FIGS. 3 and 4 for the basic structure of the pulling cord winding apparatus according to the present invention. The pulling cord winding apparatus 1 is installed on the bottom end of a bottom rail 20 of a window shade 2 to wind and house pulling cords 21 and 22 on two sides of the window shade 2. The pulling cord winding apparatus 1 includes an upper cap 3 and a lower seat 4 that are coupled together, two elastic take-up reels 5 corresponding to two holding struts 41 and 42 located in a center housing compartment 40 of the lower seat 4, two elastic coils 6 having two latch ends 60 and 61 housed and latched in the elastic take-up reels 5, a brake member 7 coupled on a post 43 located on one side of the housing compartment 40, and a push rod 8 to push the brake member 7. The brake member 7 may be moved and escape to enable the two elastic take-up reels 5 to rotate and perform brake function. Thus the two elastic coils 6 are retracted or released to extend or retract the window shade 2.

The upper cap 3 is an elongate member with a recess 30 in the center of a front end, and sunk holes 31 and 32 on two sides and one side of the center, and a contact side 33 which has a wedge flange 34 on a front end and a rear end. The wedge flange 34 on the front end has a concave notch 340 in the center.

The lower seat 4 is formed in a shape mating the upper cap 3, and has the center housing compartment 40, and the two holding struts 41 and 42 on two sides that have respectively latch slots 410 and 420. The post 43 is located on one side in the center between the two holding struts 41 and 42, and has a screw hole 430 corresponding to the sunk hole 32. On the outer side of the two holding struts 41 and 42, there are two arched retaining flanges 44 and 45. In the center of the arched retaining flanges 44 and 45, there is a cord clamping member 440 and 450 that corresponds to each other, and has first teeth 441 and 451 on one side thereof. The lower seat 4 further has fastening struts 46, and each has a screw hole 460 corresponding to the sunk hole 31. Between two fastening struts 46, there is a strut 47 to couple with an axle hole 480 of a guide reel 48. The lower seat 4 also has a concave notch 49 and a recess 491 mating the concave notch 340 and wedge flange 34 of the upper cap 3, and two apertures 492 on two sides to allow the pulling cords 21 and 22 to pass through to extend and retract the window shade 2.

The two elastic take-up reels 5 have respectively a housing space 50, an opening 500 in the center of the bottom to couple with the holding struts 41 and 42. On the inner perimeter of the housing space 50, there is a jutting retaining member 51 which has a latch trough 510. Two elastic take-up reels 5 further have respectively flanges 52 and 53 extended from two sides to form a winding zone 530 in the middle to wind the pulling cords 21 and 22.

The two latch ends 60 and 61 of the two elastic coils 6 are latched respectively on latch slots 410 and 420 of the holding struts 41 and 42, and the latch trough 510 of the retaining member 51 of the elastic take-up reels 5.

The brake element 7 has two cord pressing plates 70 extended outwards from two sides that have a cord pressing member 700. The cord pressing member 700 has second teeth 701 on one side that are engageable with the first teeth 441 and 451 of the cord clamping members 440 and 450. The cord pressing member 700 further has a cavity 702 on another side to hold a spring 703. The brake member 7 has a jutting member 71 on the front side that has a housing cavity 710, and a slot 72 in the center to couple with the post 43.

The push rod 8 has a depressing head 80 on one end and other end to insert into the housing cavity 710 of the brake member 7.

For assembly (referring to FIG. 5), wind the pulling cords 21 and 22 on the winding zone 530 of the two elastic take-up reels 5; couple the opening 500 with the holding struts 41 and 42 of the lower seat 4 with the latch ends 60 and 61 of the elastic coils 6 latched respectively in the latch slots 410 and 420 of the struts 41 and 42, and the latch trough 510 of the retaining member 51; press the arched pressing plates 70 of the brake member 7 on the winding zone 530 of the two elastic take-up reels 5 to engage the second teeth 701 of the cord pressing member 700 with the first teeth 441 and 451 of the two cord clamping members 440 and 450 (referring to FIGS. 6A and 6B); insert the push rod 8 into the housing cavity 710 of the brake member 7, and couple the slot 72 of the brake member 7 with the post 43; place the push rod 8 in the concave notch 49 of the lower seat 4; couple the wedge flange 34 of the upper cap 3 with the corresponding recess 491 of the lower seat 4; screw fastening elements 310 through the sunk holes 31 and 32 into the corresponding screw holes 460 of the fastening struts 46, and the screw hole 430 of the post 43 to finish the assembly of the pulling cord winding apparatus 1. Thread the two pulling cords 21 and 22 from two sides of the window shade 2 through the apertures 492 on two sides of the lower seat 4 and wind the pulling cords on the winding zone 530. The pulling cord winding apparatus 1 thus formed has a smaller thickness and is lighter. It can reduce the force exerting on the spring 703 inside the winding apparatus. The pulling cord winding apparatus 1 is compact and may be installed easily on the bottom end of the bottom rail 20 of the window shade 2.

Figure 5:
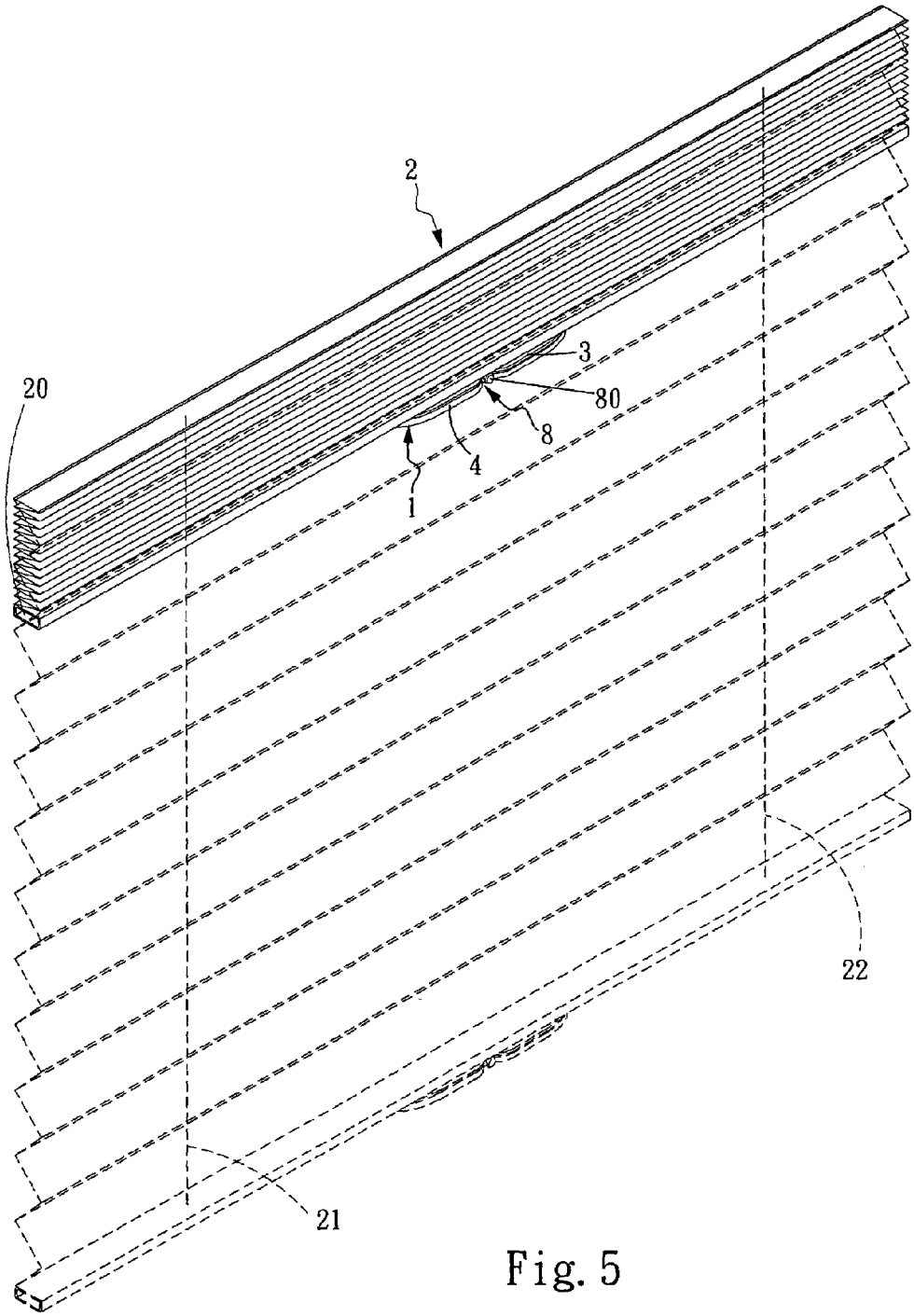
FIG. 5 is a schematic view of the present invention with the window shade in an extended condition.
Figure 6A:
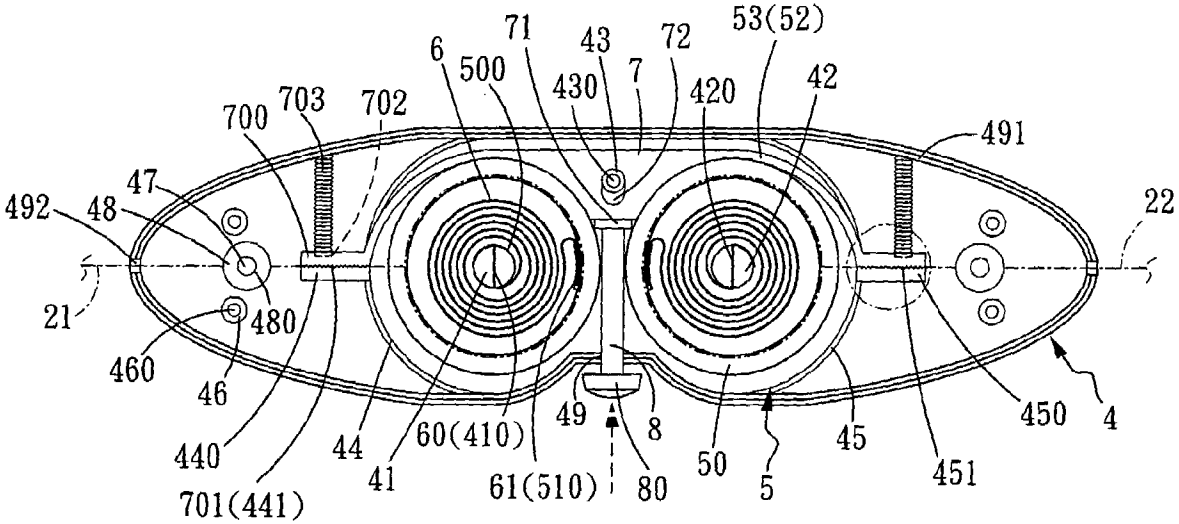
FIG. 6A is a schematic view of the winding apparatus of the invention with the push rod in a depressed condition.
Figure 6B:
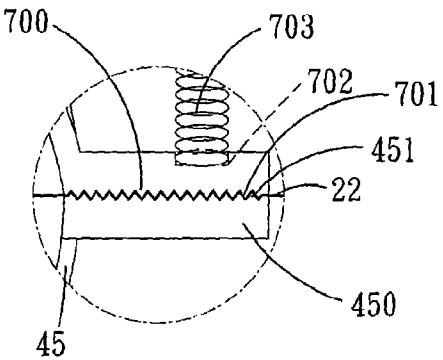
FIG. 6B is an enlarged schematic view according to FIG. 6A showing the cord clamping member and the cord pressing member in an engaging condition.
Figure 6C:
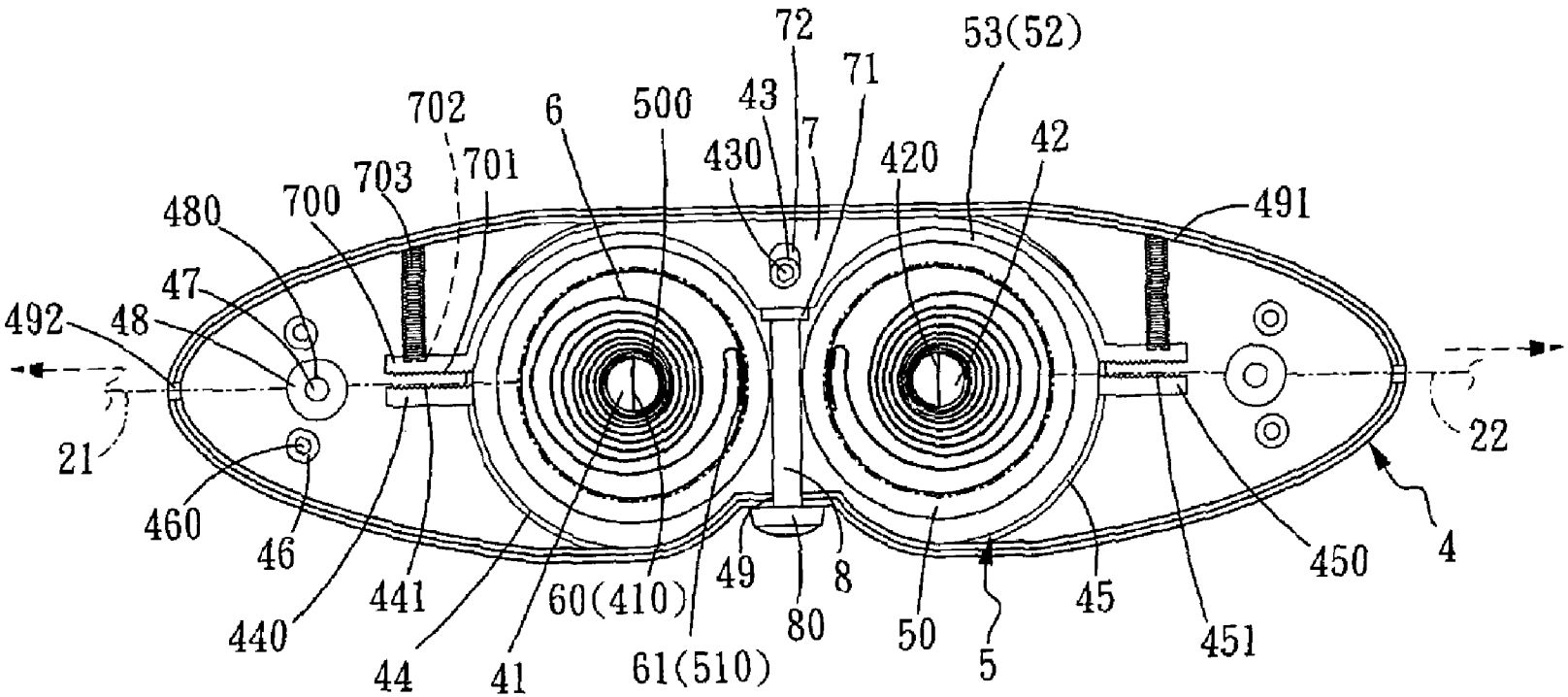
FIG. 6C is a top view according to FIG. 6A showing the pulling cord is stretched by the winding apparatus.

Referring to FIGS. 5, 6A and 6B, when in use, push the depressing head 80 of the push rod 8 to move the brake member 7 and compress the springs 703 on the two cord pressing members 700, the arched pressing plates 70 are moved away from the pulling cords 21 and 22 wound on the winding zone 530 (or returned to the compression condition). The brake member 7 escapes, and the two elastic take-up reels 5 can rotate and brake. Hence through the arched pressing plate 70, the pulling cords may be retracted smoothly without entangling or forming knobs. By means of the cord pressing members 700 and the cord clamping members 440 and 450, the pulling cords 21 and 22 do not slip when the two elastic coils 6 release the maximum forces, and the window shade 2 may be lifted and retracted or lowered and extended immediately. When there is a desired to stop the window shade 2 during extension or retraction, release the depressing head 80 of the push rod 8, the window shade 2 may be anchored at a selected elevation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pulling cord winding apparatus for window shades, comprising;

an upper cap and a lower seat that are coupled together;

two elastic take-up reels corresponding to holding struts located in a center housing compartment formed on the lower seat;

two elastic coils held in the elastic take-up reels having two ends latched on the elastic take-up reels;

a brake member coupled on a post located on one side of the lower seat; and a push rod pressing the brake member;

wherein the push rod is depressible to move the brake member to escape and allow the elastic take-tip reels to form a rotating and braking condition to allow the two elastic coils to retract or extend thereby to extend or retract a window shade; and wherein the brake member has two arched pressing plates on two sides that are extended outwards to form respectively a cord pressing member, the cord pressing member having second teeth on one side to engage with first tooth formed on two cord clamping members on two outer side of the housing compartment of the lower seat, the brake member having the jutting member on a front end which has a housing cavity, and a slot in the center to couple with the post.

2. The polling cord winding apparatus of claim 1, wherein the upper cap is an elongated member having a recess in the center of a front end, sunk holes on the top surface on two sides and one side of the center, and a contact side which has wedge flanges on a front end and a rear end.

3. The pulling cord winding apparatus of claim 2, wherein the wedge flange on the front end has a concave notch in the center.

4. The pulling cord winding apparatus of claim 1, wherein the lower seat is formed to mate with the upper cap.

5. The pulling cord winding apparatus of claim 4, wherein die holding struts have respectively a latch slot, the post being located between the two holding struts, the lower seat further having arched retaining flanges on two outer sides of the holding struts, a cord clamping member in the center of the arched retaining flanges that has first teeth on one side, fastening struts abut-ring two sides thereof that have a screw hole, a strut between the fastening struts, a concave notch corresponding to the concave notch of die upper cap, recesses on a front end and a rear end corresponding the wedge flanges of the upper cap, and two apertures on two sides.

6. The pulling cord winding apparatus of claim 1, wherein each of the elastic take-up reels has a housing space which has an opening in the center on the bottom to couple with the holding struts of die lower seat, the housing space further having a jutting retaining member on an inner perimeter that has a latch trough, the two elastic take-up reels having flanges on two sides to form a winding zone in the center to wind pulling cords located on two sides of the window shade.

7. The pulling cord winding apparatus of claim 1, wherein the elastic coils has two latch ends.

8. The pulling cord winding apparatus of claim 1, wherein the cord pressing member has a cavity on another side to hold a spring.

9. The pulling cord winding apparatus of claim 1, wherein the push rod has a depressing head on one end.

* * * * *